US006595476B1

(12) United States Patent
Edwards

(10) Patent No.: US 6,595,476 B1
(45) Date of Patent: Jul. 22, 2003

(54) ACOUSTIC CEILING BOX SUPPORT

(76) Inventor: Donald B. Edwards, 224 Quaint Acres Dr., Silver Spring, MD (US) 20904

( * ) Notice: Subject to any disclaimer, the term of this patent is extended or adjusted under 35 U.S.C. 154(b) by 0 days.

(21) Appl. No.: 09/682,105

(22) Filed: Jul. 20, 2001

(51) Int. Cl.[7] ..... E04G 3/00

(52) U.S. Cl. ..... 248/200.1; 248/906; 248/300; 248/205.1; 248/56

(58) Field of Search ..... 248/906, 200.1, 248/300, 205.1, 56, 328; 29/513; 52/506.07

(56) References Cited

U.S. PATENT DOCUMENTS

| | | | | | |
|---|---|---|---|---|---|
| 1,056,498 | A | | 3/1913 | Buckels | |
| 1,066,706 | A | * | 7/1913 | Caine | 220/3.4 |
| 1,790,031 | A | * | 1/1931 | Vaughn | 220/3.9 |
| 1,982,957 | A | | 12/1934 | Knell | |
| 2,023,083 | A | | 12/1935 | Knell | |
| 2,729,414 | A | | 1/1956 | Clark | |
| 2,962,252 | A | | 11/1960 | Frank | |
| 3,185,424 | A | * | 5/1965 | Sloop | 248/205.1 |
| 4,757,967 | A | | 7/1988 | Delmore et al. | |
| 4,790,505 | A | | 12/1988 | Rose et al. | |
| 4,957,251 | A | * | 9/1990 | Hubbard | 248/126 |
| 4,964,525 | A | * | 10/1990 | Coffey et al. | 220/3.9 |
| 4,967,990 | A | | 11/1990 | Rinderer | |
| 5,272,605 | A | | 12/1993 | Johnstone | |
| 5,330,137 | A | | 7/1994 | Oliva | |
| 5,405,111 | A | * | 4/1995 | Medlin, Jr. | 248/205.1 |
| 5,516,068 | A | | 5/1996 | Rice | |
| 6,012,685 | A | * | 1/2000 | Saraceno, Jr. | 248/68.1 |
| 6,209,836 | B1 | | 4/2001 | Swanson | |
| 6,273,377 | B1 | * | 8/2001 | Archer | 248/218.4 |
| 6,298,623 | B1 | * | 10/2001 | Wendt | 52/506.06 |

FOREIGN PATENT DOCUMENTS

| | | |
|---|---|---|
| GB | 1 425 899 | 2/1976 |

* cited by examiner

*Primary Examiner*—Ko-Hung Chan
*Assistant Examiner*—Ingrid Weinhold
(74) *Attorney, Agent, or Firm*—Stephen Christopher Swift; Swift Law Office

(57) ABSTRACT

A support for a fixture for a lighting or other electrical device, on an acoustic ceiling, so that it will be supported firmly without wobbling. In the preferred embodiment it is a rectangular metal box with an open bottom, formed from a single sheet of metal. It is dimensioned and configured so that a mounting box for the fixture can fit inside. The mounting box is prevented from moving by the broad, flat top surface of the invention. There are diagonal rows of large holes through the top side for electrical fittings, and smaller circular holes for support and grounding screws. It can be supported on the beams of the ceiling by screws that pass through slots in its ends, by using fire tie tabs, or by a stab connection. The longer side walls have flanges which rest against the top surfaces of supporting cross pieces for ceiling tiles.

7 Claims, 7 Drawing Sheets

ACOUSTIC CEILING BOX SUPPORT

BACKGROUND OF THE INVENTION

1. Field of the Invention

The present invention relates to supports for electrical devices.

2. Description of the Prior Art

There have been numerous prior inventions of supports for electrical devices, but none that are equivalent to the present invention.

U.S. Pat. No. 1,056,498, issued on Mar. 18, 1913, to Christopher C. Buckels, discloses an outlet box support, with a bar for connection between two supports, and a carrier that can slide upon the bar and holds the outlet box. The instant invention is distinguishable, in that it has a flat surface on which an outlet box can be immovably retained.

U.S. Pat. No. 1,982,957, issued on Dec. 4, 1934, to John Knell, discloses an outlet box and hanger bar, having a pair of U-shaped members with telescoping legs on which the outlet box is retained. The instant invention is distinguishable, in that it supports the outlet box on a single flat surface.

U.S. Pat. No. 2,023,083, issued on Dec. 3, 1935, to John Knell, discloses an outlet box and hanger bar, with the hanger bar comprising a pair of flat telescoping members with holes for electrical conduits. The instant invention is distinguishable, in that it has side walls for additional support, and its top surface is fixed, rather than telescoping.

U.S. Pat. No. 2,729,414, issued on Jan. 3, 1956, to Edward B. Clark, discloses a bar hanger fixture for outlet boxes, with a clamp member having an opening through which the bar hanger passes. The instant invention is distinguishable, in that in it the outlet box is retained against a flat surface with side walls.

U.S. Pat. No. 2,962,252, issued on Nov. 29, 1960, to Ben Edward Frank, discloses a hanger bar supporting clip, which is snapped over or crimped onto girders.

U.S. Pat. No. 4,757,967, issued on Jul. 19, 1988, to Martin F. Delmore and John D. Langdon, discloses an electrical box support, with a horizontal strut with a V-shaped channel on which the box can be positioned.

U.S. Pat. No. 4,790,505, issued on Dec. 13, 1988, to Steven A. Rose and Irving Birken, discloses an electrical box support bracket, in which the box is supported on a vertical U-shaped channel.

U.S. Pat. No. 4,967,990, issued on Nov. 6, 1990, to Eric R. Rinderer, discloses a support for an electrical box, comprising a bar to be mounted between two spaced-apart wall studs, without the flat supporting surface and side walls of the instant invention.

U.S. Pat. No. 5,272,605, issued on Dec. 21, 1993, to Robert M. Johnstone, discloses a canopy mounting device for exit signs and the like, with a canopy bracket having a pair of spring fingers inserted through a central circular opening of a plate mounted to an electrical box in a wall or ceiling.

U.S. Pat. No. 5,330,137, issued on Jul. 19, 1994, to John H. Oliva, discloses an apparatus and method for mounting an electrical box between studs in a wall, with a substantial cutout portion in the central part of the frame for supporting the box.

U.S. Pat. No. 5,516,068, issued on May 14, 1996, to Frank Rice, discloses a device support bracket that is open in the center, has side rails that accommodate fastening screws, and spans framing members. The device has a central aperture that makes it different from the instant invention, and does not have flanges that can rest on the top surfaces of tile supporting cross pieces, as in the instant invention.

U.S. Pat. No. 6,209,836, issued on Apr. 3, 2001, to Richard D. Swanson, discloses an electrical box mounting bracket, with a pair of support rails rather than the single top surface and side walls of the instant invention.

British Patent No. 1 425 899, complete specification published on Feb. 18, 1976, to Larry Kelly, discloses a sheet metal bracket having a pair of triangular plates.

None of the above inventions and patents, taken either singly or in combination, is seen to describe the instant invention as claimed.

BRIEF SUMMARY OF THE INVENTION

The present invention is a support for a fixture for a lighting device, smoke detector, or other electrical device, on an acoustic (hung) ceiling, so that it will be supported firmly and securely, and will not rock or wobble. In the preferred embodiment, it is a rectangular metal box with an open bottom, formed from a single sheet of metal. It is dimensioned and configured so that a mounting box for the fixture can fit inside. The mounting box is prevented from moving by the broad, flat top surface of the invention, and in some cases also by its side walls. The are large holes through the top side (preferably in diagonal rows of three circular holes across the width of the box) for electrical conduits or other fittings, and smaller circular holes for support and grounding screws. It can be supported on the beams of the ceiling either by screws that pass through slots in its ends, by using fire tie tabs on its top side, and/or by a stab connection to the acoustical ceiling "T". The longer side walls have flanges which rest against the top surfaces of the grid system (or other) supporting cross pieces for ceiling tiles.

Accordingly, it is a principal object of the invention to provide an apparatus for firmly securing lighting fixtures in acoustic ceilings, so that they will not rock or wobble.

It is another object of the invention to provide an apparatus for firmly securing other electrical fixtures in acoustic ceilings, so that they will not rock or wobble.

It is a further object of the invention to provide an apparatus for firmly securing electrical fixtures in any ceiling having cross pieces on which the apparatus can be supported.

Still another object of the invention is to provide a method for firmly securing electrical fixtures in walls or other places.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE SEVERAL VIEWS OF THE DRAWINGS

Similar reference characters denote corresponding features consistently throughout the attached drawings.

DETAILED DESCRIPTION OF THE INVENTION

The present invention is a support for electrical connector boxes, designed especially for acoustic ceilings. Acoustic ceilings are ceilings in which sound absorbing tiles are supported below the structural ceiling by cross pieces. The cross pieces are generally made of metal. The combination of the sound absorbing tiles and the space between the tiles and the structural ceiling tends to dampen noise by preventing sound waves from reflecting off the ceiling. The present invention may also be used in other kinds of ceilings, or in walls or other places.

Figure 1:
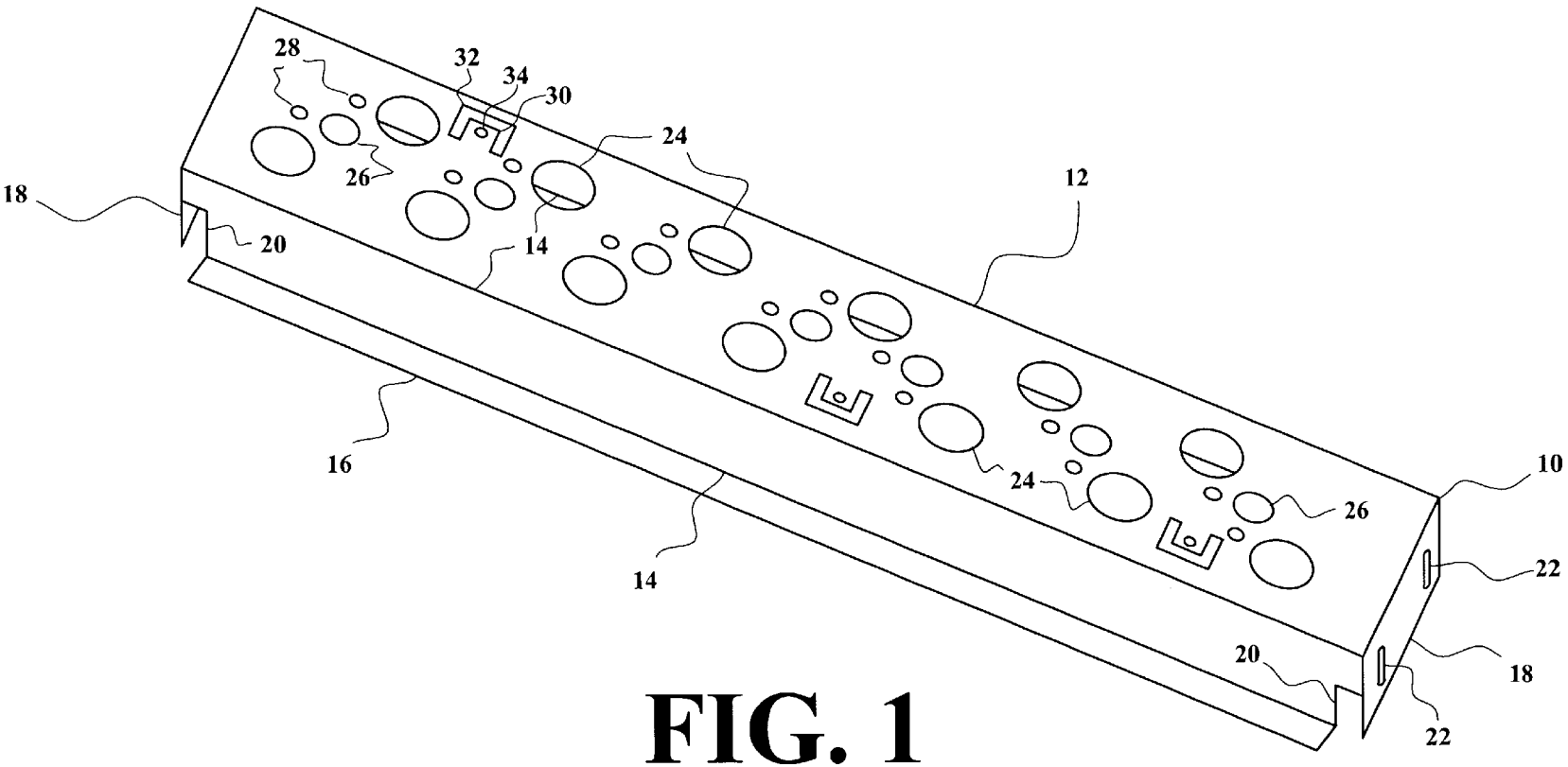
FIG. 1 is a perspective view of the first preferred embodiment of the invention.

FIG. 1 is a perspective view of the first preferred embodiment of the invention 10, including the rectangular attachment plate 12, a pair of generally rectangular connecting plates (or side walls) 14 joined at their top edges to the long sides of the attachment plate at right angles (orthogonally) from its bottom surface, a pair of rectangular supporting plates (or flanges) 16 joined to the bottom edges of the connecting plates at right angles from their outer surfaces, and a pair of side plates 18 joined to the short sides of the attachment plate at right angles from its bottom surface. The supporting plates are designed to rest on cross pieces. There are recesses 20 in the sides of the connecting plates, so that cross pieces (at right angles to the cross pieces on which the supporting plates rest) can fit between the connecting plates and the side plates. There are apertures 22 in the side plates, through which screws, nails, or other attachment members can be inserted. The attachment surface has large circular apertures 24, medium circular apertures 26, small circular apertures 28, fire tie tabs 30 formed by linear apertures 32, with circular apertures 34 in the middle of the fire tie tabs. The invention is preferably made from a single sheet of galvanized steel that is cut and bent to the desired shape. Alternatively, it may be cast in one piece in a mold, or formed from separate pieces that are welded together. The invention may also be made of plastic, fiber, composite, or any other suitable materials.

Figure 2:
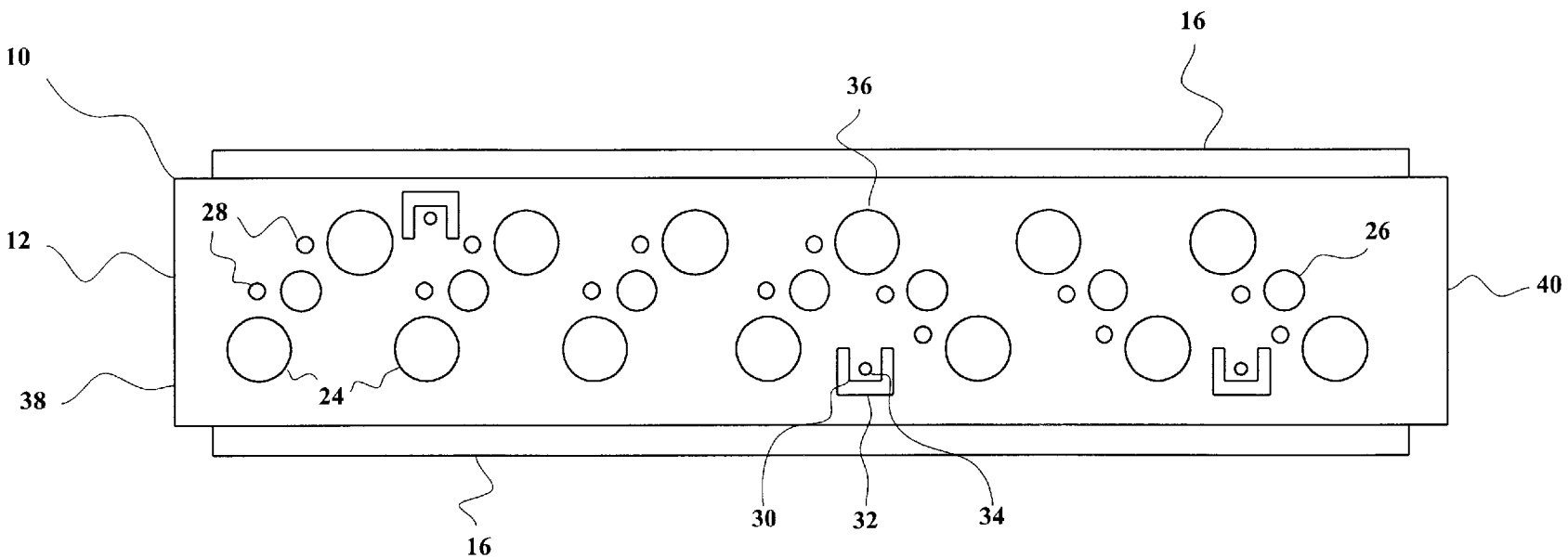
FIG. 2 is a top plan view of the first preferred embodiment of the invention.

FIG. 2 is a top plan view of the first preferred embodiment of the invention. The large and medium circular apertures are arranged in diagonal rows of three, with a medium aperture in the center of each row and the large apertures at each end. The small circular apertures are arranged in rows of two that are parallel and adjacent to the rows of the larger apertures. The large circular apertures are designed to match the larger knock out holes in electrical connection boxes found in the corners of the boxes. The medium circular apertures are designed to match the smaller knock out holes found in the centers of the boxes. The small circular apertures are designed to allow the insertion of attachment members such as screws or nails, and the insertion of grounding members such as grounding screws. The fire tie tabs are designed to accommodate supporting wires passing through the circular apertures in the tabs, with the ends of the supporting wires fastened to components of the structural ceiling. They are called fire tie tabs, because the metal supporting wires will not burn during a fire, as will wooden cross pieces. On the left side of the attachment plate the diagonal rows are slanted 45 degrees forward, while on the right side of the attachment plate the diagonal rows are slanted 45 degree backward. (Of course, these directions can be reversed simply by turning the invention 180 degrees.) One large circular aperture 36 near the center of the attachment plate is included in two rows, where the rows intersect. The advantage of reversing the direction of the rows in the middle of the plate is that this makes it possible to align connection boxes at a greater number of distances from the short edges of the attachment plate, because the distances of the centers of the holes on the left side of the plate from the left edge 38 are different from the distances of the centers of the holes on the right side of the plate from the right edge 40. (If a hole is at the distance that you desire, but is on the wrong side, simply turn the invention around 180 degrees.)

Figure 3:
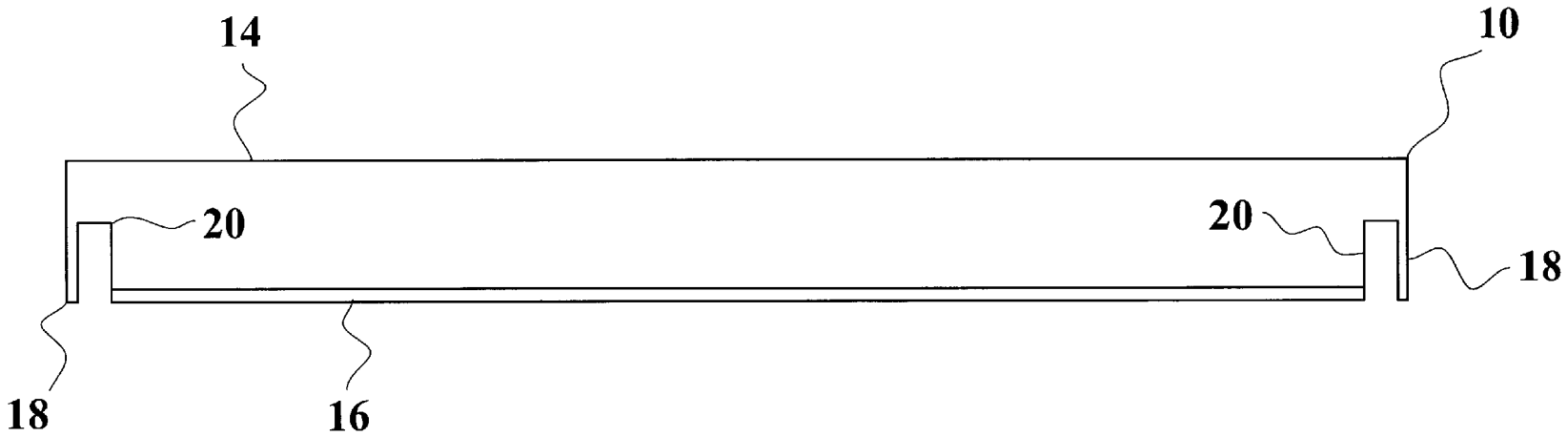
FIG. 3 is a front elevational view of the first preferred embodiment of the invention, with rear elevational view being identical.
Figure 4:
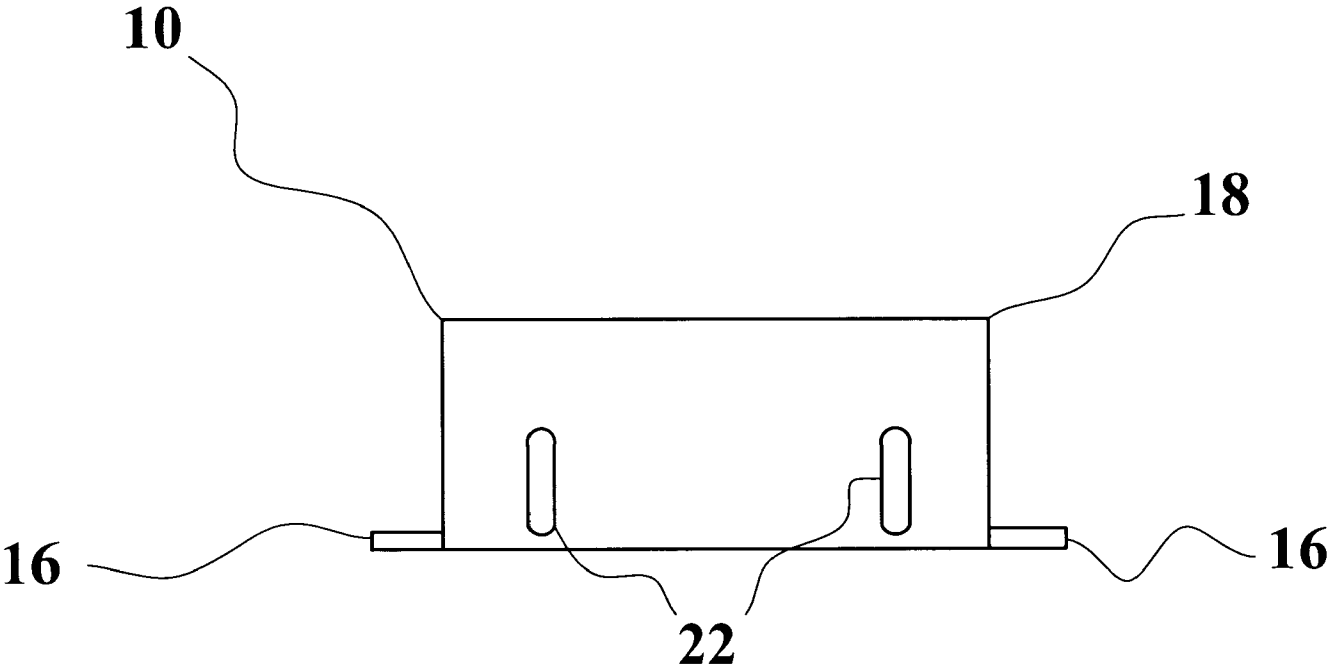
FIG. 4 is a left side elevational view of the first preferred embodiment of the invention, with the right side elevational view being identical.

FIG. 3 is a front elevational view of the first preferred embodiment of the invention, with rear elevational view being identical. FIG. 4 is a left side elevational view of the first preferred embodiment of the invention, with the right side elevational view being identical.

Figure 5:
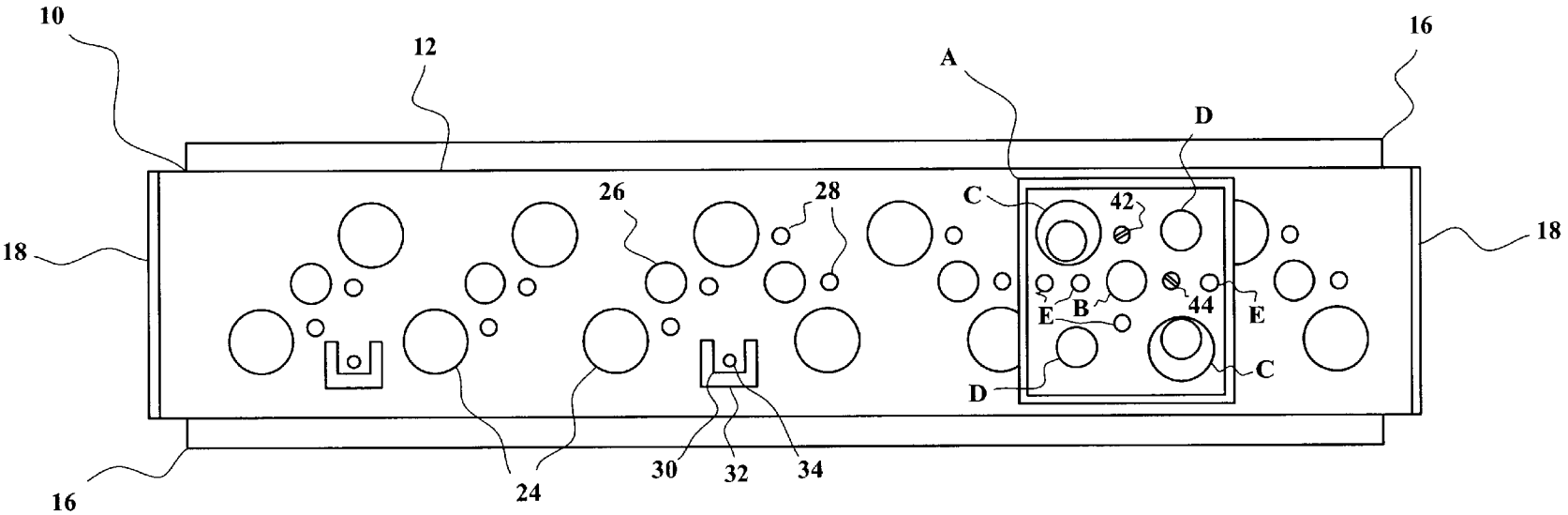
FIG. 5 is a bottom plan view of the first preferred embodiment of the invention, showing an electrical connection box attached to the invention.

FIG. 5 is a bottom plan view of the first preferred embodiment of the invention, showing a typical electrical connection box A attached to the invention. In this example, the center knock out hole B in the box has been aligned with a medium circular aperture, two small circular apertures in the box have been aligned with a row of two small circular apertures in the attachment plate, and an attachment screw 42 and a grounding screw 44 have been inserted through the small circular apertures. The knock outs have not been removed from large holes C or medium holes D, so those holes remain closed in the connection box. Small holes E in the box are not aligned with apertures in the invention.

Figure 6:
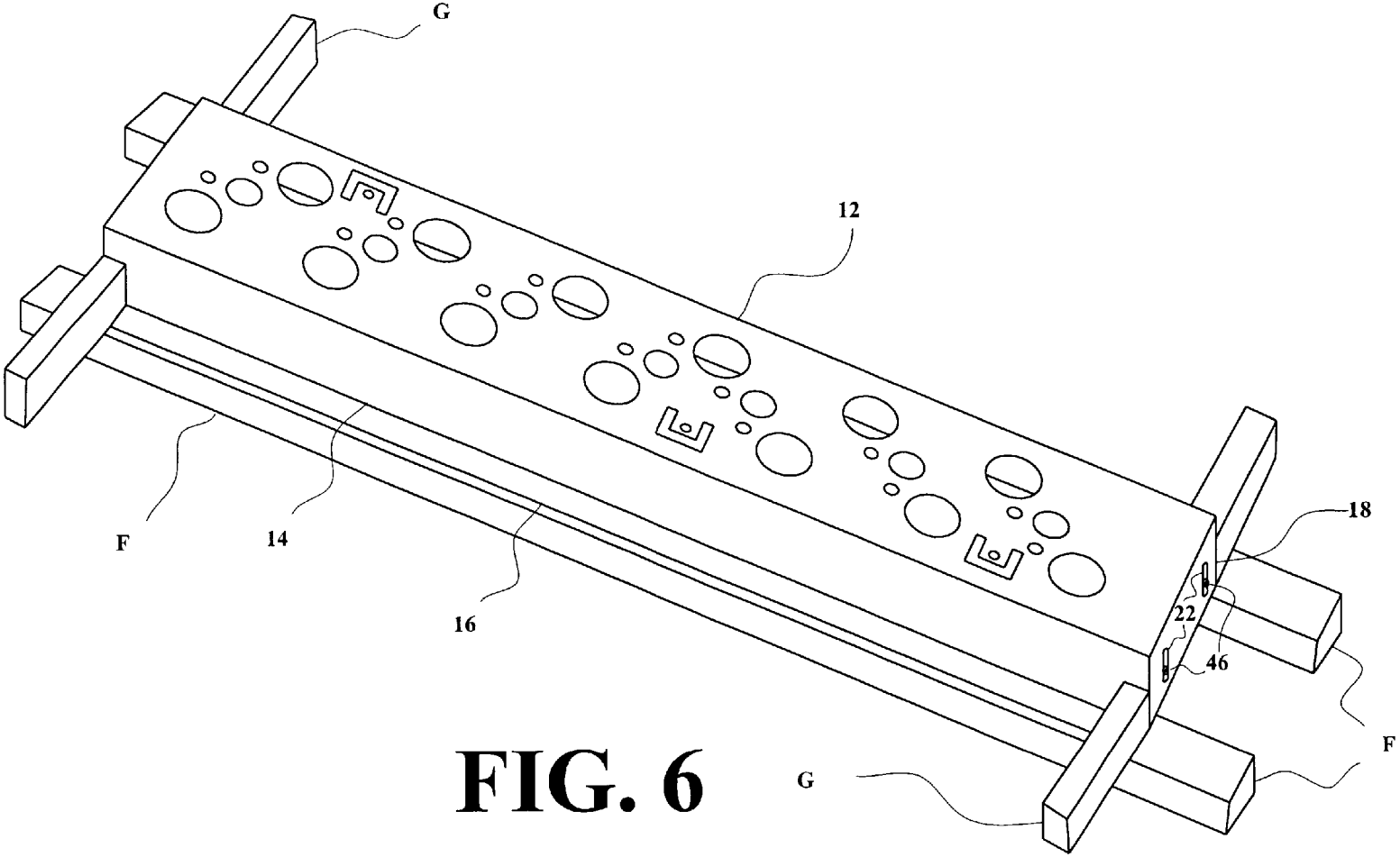
FIG. 6 is an environmental perspective view of the invention, showing it resting on tile supporting members.

FIG. 6 is an environmental perspective view of the invention, showing the supporting plates resting on cross pieces F, and the side plates attached by screws 46 to cross pieces G.

Figure 7:
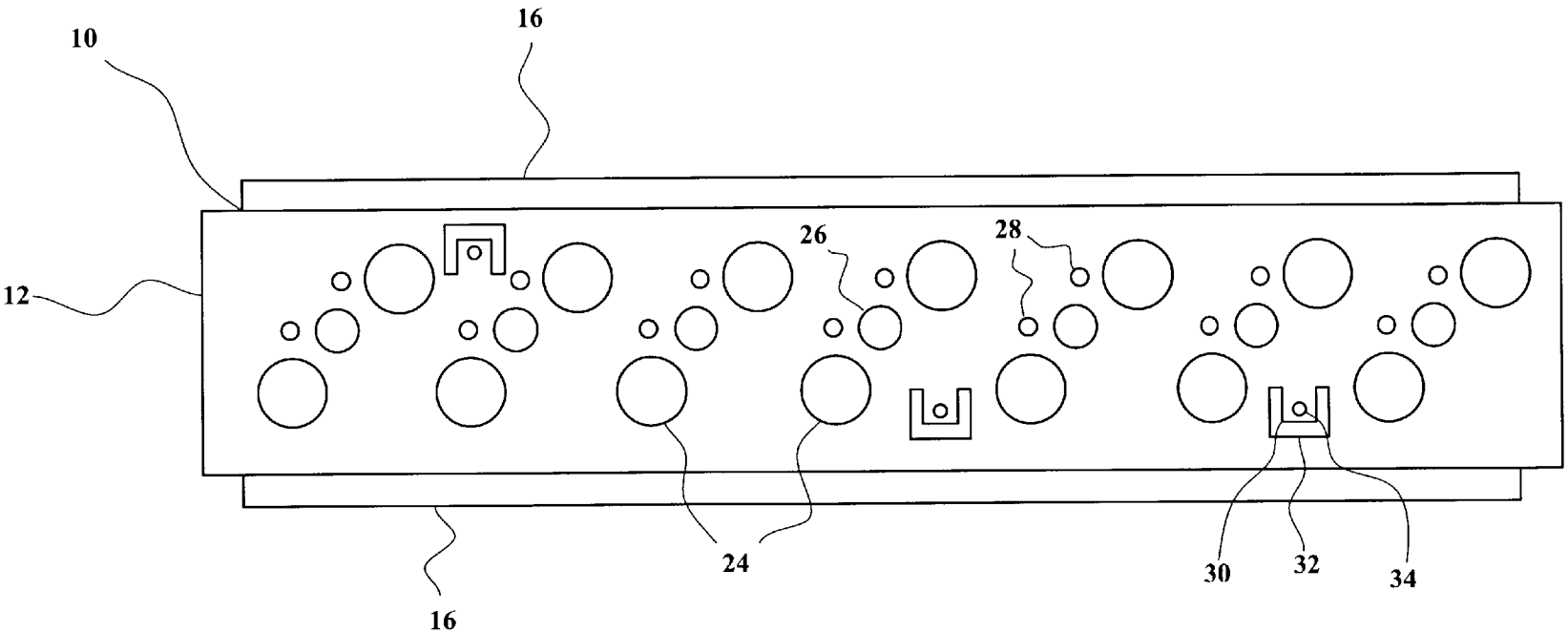
FIG. 7 is a top plan view of the second preferred embodiment of the invention.

FIG. 7 is a top plan view of the second preferred embodiment of the invention, in which the diagonal rows of apertures are all aligned in one direction. Otherwise, the second preferred embodiment is the same as the first preferred embodiment. In a third preferred embodiment (not shown in the drawings) the fire tie tabs are omitted, but otherwise the features are the same as in the first preferred embodiment.

Numbers and arrangements of the apertures that differ from those described are still within the scope of the invention. It is to be understood that the present invention is not limited to the preferred embodiments described above, but encompasses any and all embodiments within the scope of the following claims.

What is claimed is:

1. A method for attaching electrical connection boxes in an acoustic ceiling comprising the steps of:

placing a support over tile supporting members, the support comprising an attachment sheet having rows of apertures in a main body, and tabs separated from the main body on three of four sides by elongated apertures, said tabs having apertures separate from the elongated apertures and the rows of apertures in the main body, two supporting members having flat supporting surfaces that rest on the tile supporting members, and two connecting members that are each joined to the attachment sheet and one of the supporting members, wherein the attachment sheet, the supporting members and the connecting members are integrally joined in a single piece;

placing at least one electrical connection box against the rectangular attachment sheet;

passing at least one attachment member through an aperture in the electrical connection box and one of the apertures in the rectangular attachment sheet;

passing at least one grounding member through an aperture in the electrical connection box and one of the apertures in the rectangular attachment sheet;

inserting at least one electrical fitting through an aperture in the electrical connection box and one of the apertures in the rectangular attachment sheet; and inserting attachment members through apertures in side members of the support, the side members being joined to opposite sides of the attachment sheet, but to different sides than the connecting members.

2. A support, comprising:

an attachment sheet that is flat and rectangular, having diagonal rows of circular apertures, linear apertures having a plurality of linear segments that are joined to form a single aperture, and apertures adjacent to the linear apertures;

two supporting members that are flat and rectangular, having flat supporting surfaces;

two connecting members that are flat and generally rectangular, each of the connecting members being joined to the attachment sheet and one of the supporting members; and two side members that are joined to opposite sides of the attachment sheet, but to different sides than the connecting members;

wherein the attachment sheet, the supporting members and the connecting members are integrally joined in a single piece;

wherein the rows of circular apertures comprise rows of larger apertures and rows of smaller apertures, with each row of smaller apertures being adjacent to a row of larger apertures;

wherein the flat supporting surfaces of the two supporting members are coplanar with each other, but are not coplanar with the attachment sheet; and wherein the linear apertures each have a middle linear segment, and two end linear segments joined at right angles to opposite ends of the middle linear segment, with both end linear segments lying on the same side of the middle linear segment, with the apertures adjacent to the linear apertures lying between the end linear segments.

3. The support according to claim 2 wherein there is at least one aperture in each of the side members.

4. The support according to claim 3 wherein there are recesses in the connecting members adjacent to the side members.

5. A support, comprising:

an attachment sheet having rows of apertures in a main body, and tabs separated from the main body on three of four sides by elongated apertures, said tabs having apertures separate from the elongated apertures and the rows of apertures in the main body;

two supporting members that have flat supporting surfaces;

two connecting members that are each joined to the attachment sheet and one of the supporting members; and two side members that are joined to opposite sides of the attachment sheet, but to different sides than the connecting members;

wherein the attachment sheet, the supporting members and the connecting members are integrally joined in a single piece.

6. The support according to claim 5, wherein there is at least one aperture in each of the side members.

7. The support according to claim 6 wherein there are recesses in the connecting members adjacent to the side members.

* * * * *